United States Patent [19]

Edwards

[11] Patent Number: 4,760,513

[45] Date of Patent: Jul. 26, 1988

[54] RESULTANT VELOCITY CONTROL FOR MEMBERS CAPABLE OF BEING DRIVEN IN TWO COMPONENT DIRECTIONS SIMULTANEOUSLY

[75] Inventor: John B. Edwards, Sheffield, England

[73] Assignee: Coal Industry (Patents) Limited, London, England

[21] Appl. No.: 115,555

[22] Filed: Oct. 29, 1987

Related U.S. Application Data

[63] Continuation of Ser. No. 860,583, May 7, 1986, abandoned.

[30] Foreign Application Priority Data

May 31, 1985 [GB] United Kingdom ..... 8513772

[51] Int. Cl.[4] ..... G05B 11/32; E21D 9/08; H02P 7/00

[52] U.S. Cl. ..... 364/174; 299/1; 318/433; 318/434; 364/170; 364/167

[58] Field of Search ..... 364/174, 167, 170, 420, 364/422, 474, 475, 513; 318/432, 433, 434; 299/1

[56] References Cited

U.S. PATENT DOCUMENTS

| | | | |
|---|---|---|---|
| 3,735,226 | 5/1973 | Pittner | 318/432 |
| 4,031,437 | 6/1977 | Dempsey et al. | 318/433 |
| 4,031,440 | 6/1977 | Christian et al. | 318/433 |
| 4,099,782 | 7/1978 | Weirich et al. | 299/1 |
| 4,146,271 | 3/1979 | Ward et al. | 299/1 |
| 4,237,408 | 12/1980 | Freeka | 318/39 |
| 4,279,013 | 7/1981 | Cameron et al. | 364/474 |
| 4,322,113 | 3/1982 | Taylor et al. | 299/1 |
| 4,343,512 | 8/1982 | Heitkamp et al. | 299/1 |
| 4,404,505 | 9/1983 | Swanson et al. | 364/174 |
| 4,556,830 | 12/1985 | Schwalm et al. | 318/434 |
| 4,581,711 | 4/1986 | Hirata et al. | 318/434 |

*Primary Examiner*—Jerry Smith
*Assistant Examiner*—John R. Lastova, III
*Attorney, Agent, or Firm*—James Creighton Wray

[57] ABSTRACT

A method of and apparatus for controlling the resultant velocity of a member is provided, the resultant velocity being derived by driving the member in two component directions, simultaneously. First sensor means derive a signal indicative of the resultant velocity, the derived signal being compared with a preselected reference signal to derive an error signal constituting a resultant velocity demand signal which is integrated to obtain a resultant amount of movement demand signal. The resultant amount of movement demand signal is selected from 'look-up' reference table memory means and corresponding desired values derived for the amounts of movement of the member in the two component directions. The desired values are compared with signals derived from the first and second sensor means sensing the movement of member and error signals are obtained for controlling the driving of the member in the two component directions.

11 Claims, 2 Drawing Sheets

Figure 1:
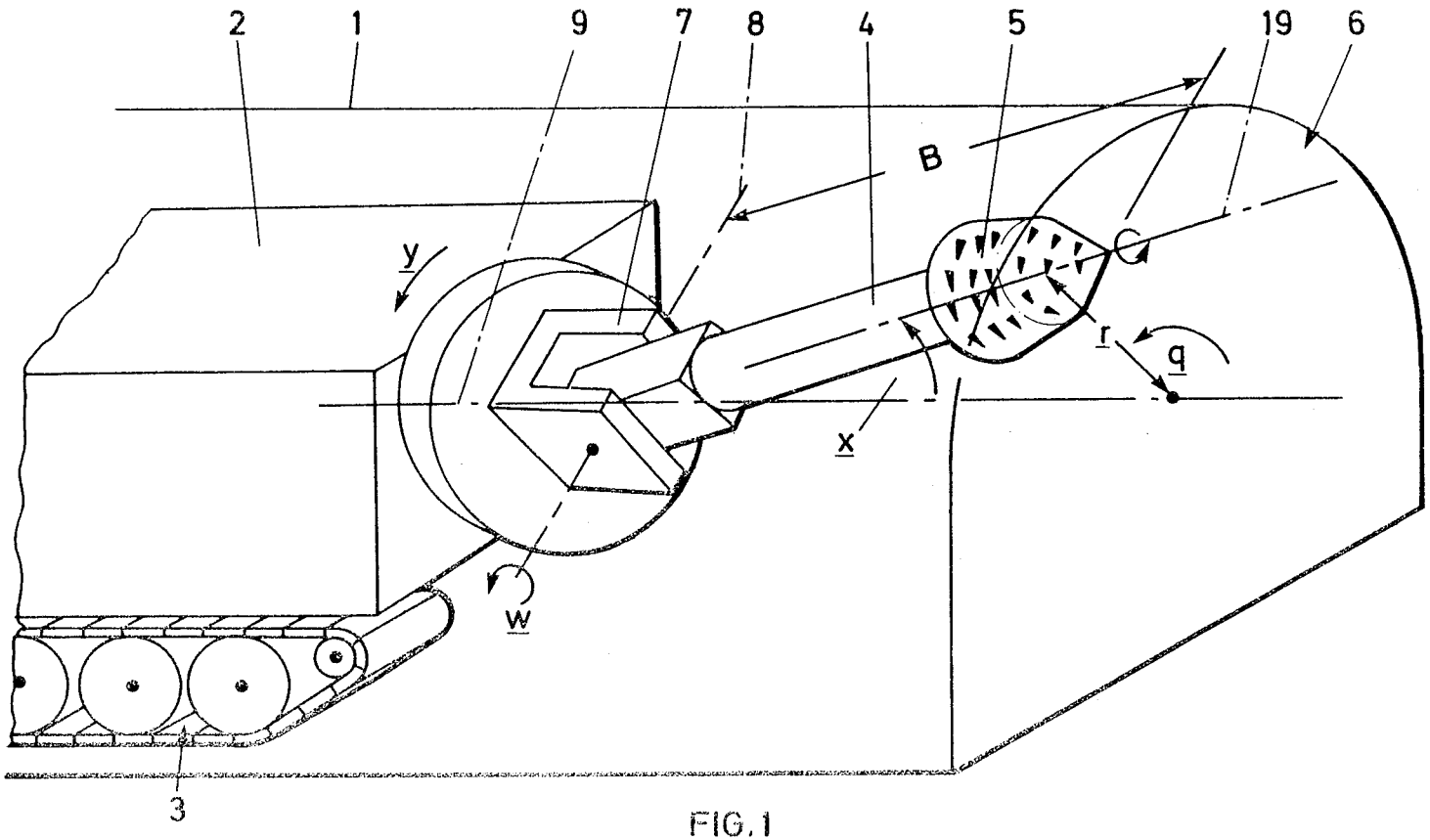

RESULTANT VELOCITY CONTROL FOR MEMBERS CAPABLE OF BEING DRIVEN IN TWO COMPONENT DIRECTIONS SIMULTANEOUSLY

This application is a continuation of Ser. No. 06/860,583 filed May 7, 1986 and now abandoned.

This invention relates to methods of and apparatus for controlling the resultant velocity of members capable of being driven in two component directions simultaneously.

In particular, although not exclusively, the present invention relates to a method of load control and to control apparatus for a cutter carrying boom member capable of undergoing a resultant movement derived by driving the boom member in two component directions, simultaneously, the controlled load being dependent upon the velocity of the resultant movement. The cutter carrying boom member is provided on an excavating machine and is required to undergo the resultant movement in order to traverse a cutter carried by the boom member along a cutter path over a working rock or mineral face.

Previously, load control systems have been proposed for excavating machines having cutter carrying boom members capable of undergoing movement constituted by only one component direction. For example, the boom member is capable of moving the cutter along a curved path about a vertical axis, or about a horizontal axis arranged substantially parallel to the working face, or about an axis extending substantially normal to the working face or along a linear path following a slideway or guideway.

Such prior known load control systems are comparatively straightforward (although not trivial) and utilise sensor means to determine the cutter power consumption, the system controlling the drive for, and, therefore, the speed of, the boom member movement to ensure the sensed cutter power consumption does not exceed a preselected full load value and the cutter drive is not overloaded.

However, once the cutter is required to trace out a cutting path requiring the boom member to undergo a resultant movement constituted by movements in two component directions, simultaneously, then known control systems are unable to efficiently control the two component drives involved.

An object of the present invention, is to provide an improved control method and improved control apparatus which tend to overcome or reduce the above mentioned problem.

Accordingly, one aspect of the present invention provides a method of controlling the resultant velocity of a member, the resultant velocity being derived by driving the member in two component directions, simultaneously, wherein first sensor means sense a first parameter which, in use, is indicative of the resultant velocity, second and third sensor means sense second and third parameters which, in use, are indicative of the amounts of movement of the member in the two component directions, respectively, the first, second and third sensor means deriving first, second and third derived signal means indicative of the sensed first, second and third parameters, respectively, the first derived signal means being compared with reference signal means indicative of a desired preselected value of the first parameter to derive first error signal means constituting resultant velocity demand signal means which is integrated to obtain resultant amount of movement demand signal means, the obtained resultant amount of movement demand signal means being selected from lists of values stored in reference table memory means to determine associated listed predetermined desired value signal means for the second and third parameters, respectively, and comparing the determined desired value signal means with the aforementioned second and third derived signal means to derive second and third error signal means which, in use, control drive means for driving the member in the two component directions.

The present invention also provides a method of load control for a boom member capable of undergoing a resultant movement derived by driving the boom member in two component directions, simultaneously, the controlled load being dependent upon the velocity of the resultant movement, wherein first sensor means sense a first parameter which, in use, is indicative of the controlled load and which is dependent upon the resultant velocity of the boom member, second and third sensor means sense second and third parameters which, in use, are indicative of the amounts of movement of the boom member in the two component directions, respectively, the first second and third sensor means deriving first, second and third derived signal means indicative of the sensed first, second and third parameters, respectively, the first derived signal means being compared with reference signal means indicative of a desired preselected load to derive first error signal means constituting resultant velocity demand signal means which is integrated to obtain resultant amount of movement demand signal means, the obtained resultant amount of movement demand signal means being selected from lists of values stored in reference table memory means to determine associated listed predetermined desired value signal means corresponding to desired values of the second and third parameters, respectively, and wherein the determined desired value signal means are compared with the aforementioned second and third derived signal means to derive a second and third error signal means, which, in use, control drive means for driving the boom member in the two component directions.

The present invention also provides a method of load control for a cutter carrying boom member mounted on an excavating machine, the boom member being capable of undergoing a resultant movement derived by driving the boom member in two component directions, simultaneously, the controlled load being dependent upon the velocity of the resultant movement, wherein first sensor means sense a first parameter which, in use, is indicative of the controlled load and which is dependent upon the resultant velocity of the boom member, second and third sensor means sense second and third parameters which, in use, are indicative of the amounts of movement of the boom member in the two component directions, respectively, the first, second and third sensor means deriving first, second and third derived signal means indicative of the sensed first, second and third parameters, respectively, the first derived signal means being compared with reference signal means indicative of a desired preselected load to derive first error signal means constituting resultant velocity demand signal means which is integrated to obtain resultant amount of movement demand signal means, the obtained resultant amount of movement demand signal means being selected from lists of values stored in reference table memory means to determine associated listed predetermined desired value signal means corresponding to desired values of the second and third parameters, respectively, and wherein the determined desired value signal means are compared with the aforementioned second and third derived signal means to derive second and third error signal means which, in use, control drive means for driving the boom member in the two component directions.

Preferably, the first sensor means senses the power consumption of a motor for driving the cutter.

Alternatively, the first sensor means senses the current consumption of a motor driving the cutter.

Alternatively, the first sensor means senses a load, force or torque exerted on a member of the excavating machine.

Alternatively, the first sensor means senses pressure of activating fluid fed to a fluid drive associated with the excavating machine.

According to a second aspect the present invention provides apparatus for controlling the resultant velocity of a member, the resultant movement being derived by driving the member in two component directions, simultaneously, comprising first sensor means for sensing a first parameter which, in use, is indicative of the resultant velocity, second and third sensor means for sensing second and third parameters which, in use, are indicative of the amounts of movement of the member in the two component directions, respectively, the first, second and third sensor means being adapted to derive first, second and third derived signal means indicative of the sensed first, second and third parameters, respectively, means for comparing the first derived signal means with reference signal means indicative of a desired preselected value of the first parameter and for deriving first error signal means constituting resultant velocity demand signal means, integrator means for integrating the resultant velocity demand signal means to obtain resultant amount of movement demand signal means, means for selecting the resultant amount of movement demand signal means from lists of values stored in reference table memory means to determine associated listed predetermined desired value signal means for the second and third parameters, respectively and further means for comparing the determined desired value signal means with the aforementioned second and third derived signal means to derive second and third error signal means which, in use, control drive means for driving the member in the two component directions.

The present invention also provides load control apparatus for a boom member capable of undergoing a resultant movement derived by driving the boom member in two component directions, simultaneously, the controlled load being dependent upon the velocity of the resultant movement, comprising first sensor means for sensing a parameter which, in use, is indicative of the controlled load and which is dependent upon the resultant velocity of the boom member, second and third sensor means for sensing second and third parameters which, in use, are indicative of amounts of movement of the boom member in the two component directions, respectively, the first, second and third sensor means being adapted to derive first, second and third derived signal means indicative of the sensed first, second and third parameters, respectively, means for comparing the first derived signal means with reference signal means indicative of a desired preselected load to derive first error signal means constituting resultant velocity demand signal means, integrator means for integrating the resultant velocity demand signal means to obtain resultant amount of movement demand signal means, means for selecting the obtained resultant amount of movement demand signal means from lists of values stored in reference table memory means to determine associated listed predetermined desired value signal means corresponding to desired valves of the second and third parameters, respectively, and further means for comparing the determined desired value signal means with the aforementioned second and third derived signal means to derive a second and third error signal means, which, in use, control drive means for driving the boom member in the two component directions.

The present invention also provides load control apparatus for a cutter carrying boom member mounted on an excavating machine, the boom member being capable of undergoing a resultant movement derived by driving the boom member in two component directions, simultaneously, the controlled load being dependent upon the velocity of the resultant movement, comprising first sensor means for sensing a first parameter which, in use, is indicative of the controlled load and which is dependent upon the resultant velocity of the boom member, second and third sensor means for sensing second and third parameters which, in use, are indicative of the amounts of movement of the boom member in the two component directions, respectively, the first, second and third sensor means being adapted to derive first, second and third derived signal means indicative of the first, second and third parameters, respectively, means for comparing the first derived signal means with reference signal means indicative of a desired preselected load to derive first error signal means constituting resultant velocity demand signal means, integrator means for integrating the resultant velocity demand signal means to obtain resultant amount of movement demand signal means, means for selecting the obtained resultant amount of movement demand signal means from lists of values stored in reference table memory means to determine associated listed predetermined desired value signal means corresponding to desired values of the second and third parameters, respectively, and means for comparing the determined desired value signal means with the aforementioned second and third derived signal means to derive second and third error signal means which, in use, control drive means for driving the boom member in the two component directions.

The scope of the present invention also directed to an excavating machine comprising a cutter carrying boom member and load control apparatus as defined above.

Figure 2:
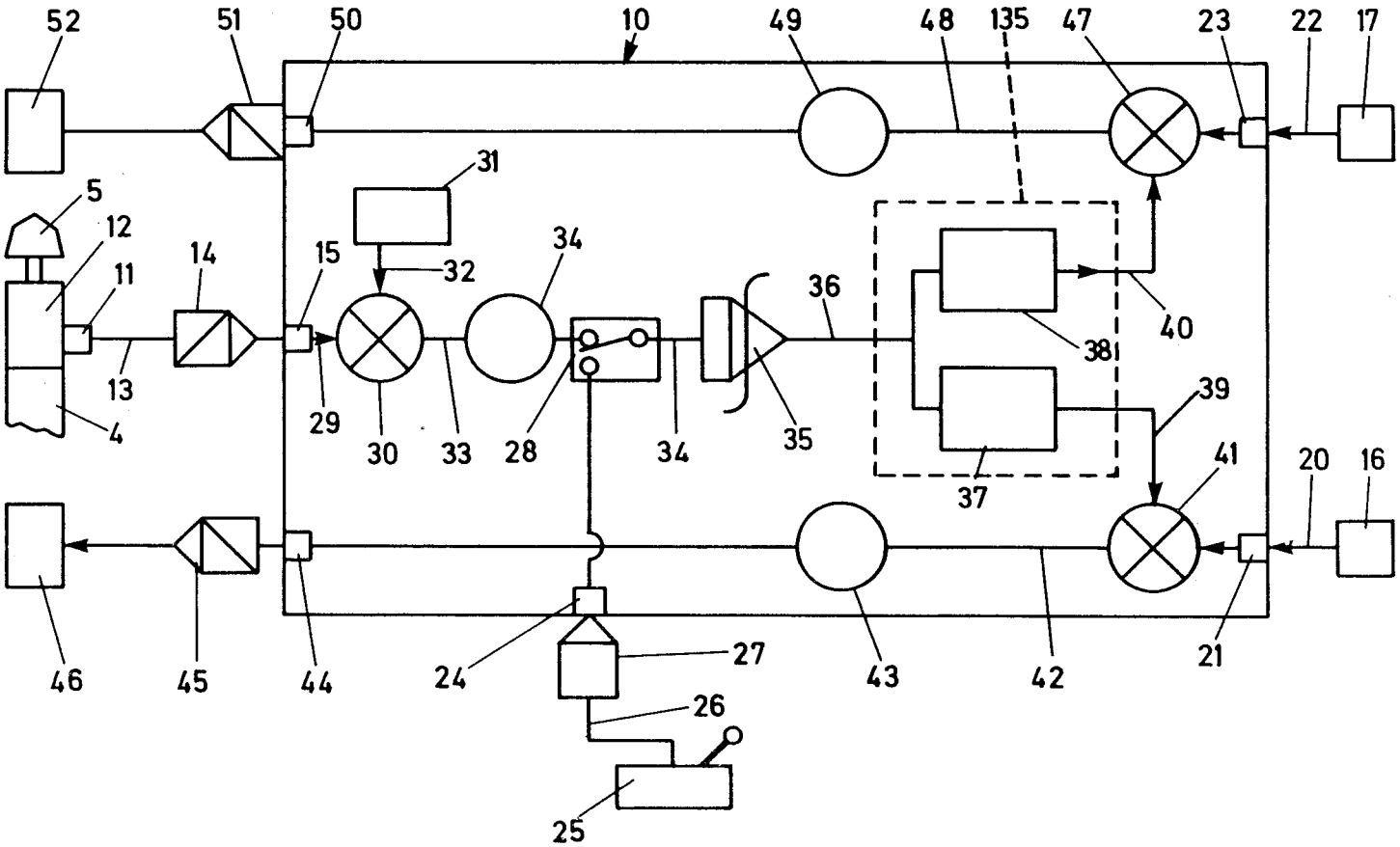

By way of example, one embodiment of the invention will be described with reference to the accompanying drawings, in which:

FIG. 1 shows diagrammatically a leading portion of an excavating machine having a cutter carrying boom member capable of undergoing a resultant movement derived by driving the boom member in two component directions, simultaneously; and FIG. 2 is a block circuit diagram of load control apparatus constructed in accordance with the present invention.

FIG. 1 shows a mine roadway 1 and a leading portion of an underground mine roadway excavating machine having a body 2 mounted on tracks 3 (only one of which is shown) and supporting a forwardly extending, cutter carrying boom member 4 provided with a rotary cutter 5 for excavating rock or mineral from a generally 'D' shape working face 6 to extend the roadway 1. The boom member 4 is pivotally mounted in a turret 7 for movement about an axis 8 arranged substantially parallel to the working face. The turret 7 is mounted on body 2 for rotational movement about an axis extending substantially normal to the working face, the axis 9 being co-axial with the longitudinal axis of the roadway. Drives (not shown in FIG. 1) are provided for rotating the turret and for pivoting the boom member about the axis 8. References on FIG. 1 indicating various angles and lengths will be referred to later in this specification.

In operation, the cutter is traversed along a desired preselected cutting path over the working face by controlled movement of the boom member, the controlled movement including over portions of the cutting path a resultant movement derived by driving the boom member in two component directions, simultaneously. The two directional components of movement are constituted by the component due to the boom member pivoting about the axis 8 and by the component due to the turret being rotated about the axis 9.

The load control apparatus for the excavating machine of FIG. 1 is shown in FIG. 2 in the form of a block circuit diagram including processing means constituted by a computer 10.

The load control apparatus comprises a transducer 11 for sensing the power consumption of a motor 12 for rotating the cutter 5. The transducer 11 derives a signal $P_i$ indicative of the power consumption and feeds the signal along line 13 via an analogue to digital converter 14 to an input 15 on the computer 10.

Two encoders 16 and 17 are provided for sensing rotational movements, the encoder 16 senses the rotation w of the boom member about the axis 8 and, thereby, the inclination x of the boom member to the longitudinal axis 9 of the roadway 1. From the determined inclination x and knowing the length B of the boom member 4, the actual radial distance $r_a$ from the rotary axis 19 of the cutter to the roadway axis 9 also is known by calculation. The encoder 17 senses the actual rotation $y_a$ of the turret 7 about the roadway axis 9, the sensed rotation $y_a$ being equal to the angle q between the radial having the length $r_a$ and the horizontal.

The encoder 16 derives a signal $S_r$ indicative of the calculated actual radius $r_a$ which is fed along line 20 to an input 21 on the computer. The encoder 17 derives a signal $S_q$ indicative of the rotation of the radial distance $r_a$ from the horizontal, the derived signal $S_q$ being fed along line 22 to an input 23 on the computer.

The computer is provided with a further input 24 for receiving signals from a manual override speed control 25, the manual control signal being fed to the input 24 via a line 26 and an analogue to digital converter 27. A switch 28 provided in the control apparatus selects the desired operational mode, i.e., controlled or manual. In FIG. 2 the switch is shown in the controlled mode.

From the aforementioned input 15 the signal $P_i$ is fed along line 29 to means 30 where it is compared with a preselected reference signal $P_R$ previously fed into a memory 31 of the computer and indicative of a desired full load power consumption by the motor 12. The means 30 may comprise hardware or software signal comparator or subtraction means. The signal $P_R$ is fed from the memory 31 to the means 30 along line 32. The means 30 derives an error signal $P_e$ indicative of the difference between reference signal $P_R$ and the derived signal $P_i$, the error signal $P_e$ being fed along line 33 to a processor section 34 where a velocity demand signal $V_d$ is derived by multiplying the error signal $P_e$ by a preselected gain value. The velocity demand signal $V_d$ is indicative of any adjustment which might be required to the speed of the cutter as it traverses the working face along its cutting path in order that the sensed power consumption should tend to be maintained at the same level as the maximum desired power consumption indicated by reference signal $P_R$. Thus, if the sensed power consumption taken by the cutter motor 12 is above the reference power consumption the cutter traversing speed must be reduced by an appropriate amount. If the sensed power consumption taken by the cutter motor 12 is significantly below the reference power consumption then the cutter traversing speed must be appropriately increased. If the signals $P_i$ and $P_R$ are substantially equal, then no adjustment of the cutter traversing speed is called for.

The derived velocity demand signal $V_d$ is fed along line 134 via the aforementioned switch 28 to a signal integrating section 35 and a resultant amount of movement demand signal $D_d$ is obtained by integrating the velocity demand signal. The resultant amount of movement may comprise a distance, for example in the case of radius r or it may comprise an angle, for example in the case of angle q.

The derived resultant amount of movement demand signal $D_d$ is fed along branch line 36 to memory processor means 135 including reference tables means 37, 38 previously fed into the memory processor means.

The reference table means 37 lists a series of possible values of the resultant amount of movement demand signal and along side, a series of associated predetermined desired values $r_d$ for the aforementioned calculated, actual radial distance $r_a$. The reference table means 38 lists a series of possible values of the derived resultant amount of movement demand signal and along side a series of associated, predetermined desired values $y_d$ for the sensed rotation of the turret 7 and thereby of the boom member 4. The memory processor means 135 selects the appropriate desired signal values $r_d$ and $y_d$ from the reference tables memory means and feeds these desired signal values along lines 39, 40, respectively.

The desired signal value $R_d$ is fed to means 41 for comparing the desired value $r_d$ with the aforemention actual value $r_a$ fed into the computer via inlet 21. The difference between the two values produces an error signal $r_e$ which is fed along line 42 via a gain-amplifier 43 to an outlet 44 and hence via a digital to analogue converter 45 to first drive means for driving the boom members in one component direction to adjust the boom member elevation about the pivot axis 8. In FIG. 2 the first drive means is designated by reference number 46, and typically, for a hydraulic drive comprises a swash plate speed control valve arrangement. The derived error signals $r_e$ is used to rotate the servo amplifier of the swash plate arrangement to adjust the speed of the drive such that the actual radial distance $r_a$ tends towards the desired radial distance $r_d$.

Simultaneously, the desired signal value $y_d$ is fed to means 47 for comparing the desired value $r_d$ with the aforementioned actual rotational value $y_a$ fed into the computer via inlet 23. The difference between the two values produces an error signal $y_e$ which is fed along line 48 via a gain amplifier 49 to an outlet 50 and hence via a digital to analogue converter 51 to second drive means for driving the boom member in the second component direction to adjust the turret rotation about the axis 9. In FIG. 2 the second drive means is designated by reference number 52 and, typically, for a hydraulic drive comprises a swashplate speed control valve arrangement. The derived error signal $y_e$ is used to rotate the servo amplifier of the swashplate arrangement to adjust the speed of the drive such that the actual turret rotation $y_d$ tend towards the desired turret rotation $y_d$.

The means 41 and 47 may comprise hardware or software signal comparator or subtraction means.

Thus, it will be appreciated that the traversing speed of the cutter is maintained at a desired preselect speed and the drive motor 12 is not overloaded.

In other embodiments of the invention the load sensor means senses the load or torque exerted on a member of the machine as for example on a boom member, a joint assembly or an abutment shoulder. Alternatively, the load sensor means may sense the power consumption taken by a motor other than the cutter motor. In still further embodiments the load sensor means senses the current taken by the cutter motor or any other desired motor. In the case of hydraulic drives, for example, the load sensor means might sense the pressure of hydraulic fluid in a drive.

A load control system in accordance with the present invention may be used on any suitable excavating machine, of for example, a machine having a pivotally or rotatably mounted hinged boom assembly or one in which the boom member or assembly is pivotally supported for movement about two pivotal axes. Alternatively, the boom member or assembly may be slidably mounted for movement. in at least one of the directional components of movement The invention also provides a load control system suitable for other equipment comprising a boom member on assembly capable of undergoing resultant movement constituted by two simultaneous directional components of movement, as for example, a robot arm assembly.

I claim:

1. Load control apparatus for a boom member carrying a cutter and capable of undergoing a resultant movement derived by driving the boom member in two component directions, simultaneously, the controlled load being dependent upon the velocity of the resultant movement, comprising, first sensor means for sensing a parameter indicative of the actual controlled load and which is dependent upon the resultant velocity of the boom member, second sensor means for sensing a parameter indicative of an amount of movement of the boom in one of the two component directions, third sensor means for sensing a parameter indicative of an amount of movement of the boom in the other component direction, the first, second and third sensor means generating first, second and third sensor derived signals indicative of the sensed first, second and third parameters, respectively, first comparison means for comparing the first sensor derived signal with a preselected reference signal indicative of a desired preselected load and generating a first error signal when the reference signal does not correspond to the first sensor derived signal, first processor means for receiving the first error signal and generating a velocity demand signal by multiplying the first error signal by a preselected gain value, wherein the velocity demand signal is indicative of any adjustment which might be required to the velocity of the boom member moving along a path to maintain the desired preselected load, integrator means for integrating the velocity demand signal and generating a movement demand signal, processor means for receiving the movement demand signal and selecting from memory desired signal values for the second and third parameters from preprogrammed reference tables, which list a series of possible values of the movement demand signals that correspond to a series of associated desired value signals corresponding to desired values of the second and third parameters, respectively, second comparison means for comparing the second sensor derived signal with the selected desired value of the second parameters from the reference table and generating a second error signal, third comparison means for comparing the third sensor derived signal with the selected desired value of the third parameter from the reference table and generating a third error signal and drive means, responsive to the second and third error signals, for driving the boom member in the two component directions at a velocity calculated to adjust the actual controlled load to match the desired preselected load.

2. Load control apparatus for a cutter carrying boom member mounted on an excavating machine, the boom member being capable of undergoing a resultant movement derived by driving the boom member in two component directions, simultaneously, the controlled load being dependent upon the velocity of the resultant movement, comprising, first sensor means for sensing a first parameter indicative of the controlled actual load and which is dependent upon the resultant velocity of the boom member, second sensor means for sensing a parameter indicative of an amount of movement of the boom in one of the two component directions, third sensor means for sensing a parameter indicative of an amount of movement of the boom in the other component direction, the first, second and third sensor means generating first, second and third sensor derived signals indicative of the sensed first, second and third parameters, respectively, first comparison means for comparing the first sensor derived signal with a preselected reference signal indicative of a desired preselected load and generating a first error signal when the reference signal does not correspond to the first sensor derived signal integrator means for integrating the velocity demand signal and generating a movement demand signal, processor means for receiving the movement demand signal and selecting from memory desired signal values for the second and third parameters from preprogrammed reference tables, which list a series of possible values of the movement demand signals that correspond to a series of associated desired value signals corresponding to desired values of the second and third parameters, respectively, second comparison means for comparing the second sensor derived signal with the selected desired value of the second parameter from the reference table and generating a second error signal, third comparison means for comparing the third sensor derived signal with the selected desired value of the third parameter from the reference table and generating a third error signal and drive means, responsive to the second and third error signals, for driving the boom member in the two component directions at a velocity calculated to adjust the actual controlled load to match the desired preselected load.

3. An excavating machine comprising a cutter carying boom member and load control apparatus as claimed in claim 2.

4. A control apparatus for maintaining a predetermined load on a motor driving a cutting head rotatably supported on a boom movable about first and second axes, comprising, first sensor means for sensing power consumption of the motor, wherein the first sensor means generates a power consumption signal, second sensor means for sensing rotation of the beam about the first axis, wherein the second sensor means generates an actual position signal with respect to the first axis, third sensor means for sensing rotation of the boom about the second axis, wherein the third sensor means generates an actual position signal with respect to the second axis, first comparison means for comparing the power consumption signal to a predetermined load reference signal stored in memory means, wherein the reference signal indicates the predetermined load, means for deriving a first error signal indicating a difference between the reference signal and the power consumption signal, means, responsive to the error signal, for deriving a velocity demand signal, means, responsive to the velocity demand signal, for deriving a movement demand signal, means, responsive to the movement demand signal and for selecting desired position signals of the boom about the first and second axes, respectively, wherein each movement demand signal has corresponding desired position signals of the boom about the first and second axes, respectively, stored in memory, second comparison means for comparing the desired position signals to the actual position signals with respect to the first axis and generating a second error signal when desired and actual position signals are not equal, third comparison means for comparing the desired position signals to the actual position signal with respect to the second axis and generating a third error signal when desired and actual position signals are not equal, and means, responsive to the second and third error signals, for moving the boom about the two axes until sensed power consumption matches the predetermined load.

5. A apparatus as claimed in claim 4, wherein the first sensor means senses the power consumption of a motor for driving the cutter.

6. A apparatus as claimed in claim 4, wherein the first sensor means senses the current consumption of a motor for driving the cutter.

7. A apparatus as claimed in claim 4, wherein the first sensor means senses a load, force or torque exerted on a member of an excavating machine.

8. A apparatus as claimed in claim 4, wherein the first sensor means senses pressure of activating fluid fed to a fluid drive associated with an excavating machine.

9. The apparatus of claim 4 wherein the first axis is transverse to the second axis.

10. The apparatus of claim 4 further comprising a manual override switch and means for providing a manual control signal that bypasses the velocity demand signal.

11. A method of controlling load on a motor driving a cutter head of a mining machine supported on a boom rotatable about an axis of an excavated roadway and pivotal about an axis transverse to the roadway axis, comprising, sensing operating load of the motor and generating a signal indicative of the operating load, comparing a predetermined preferred operating load signal with the sensed operating load signal, deriving an error signal from a difference between the compared signals, deriving a velocity demand signal from the error signal, deriving a movement demand signal from the velocity demand signal, selecting a desired position signal for each of the two axes, sensing the rotation of the boom about each of the two axes and generating a signal indicative of the actual position of the boom about each of the two axes, comparing the desired position signal for each of the two axes with the corresponding sensed position signal for each of the two axes, deriving an error signal for each of the two axes from the respective differences between the compared signals, and moving the boom in response to the error signal from each of the two axes at a speed which results in the elimination of the error signals.

* * * * *